US011648608B1

(12) United States Patent
Liu et al.

(10) Patent No.: US 11,648,608 B1
(45) Date of Patent: May 16, 2023

(54) SECONDARY COOLING CONTROL METHOD FOR REINFORCING SURFACE SOLIDIFICATION STRUCTURE OF MICROALLOYED STEEL CONTINUOUS CASTING BLOOM

(71) Applicant: University of Science and Technology Beijing, Beijing (CN)

(72) Inventors: Qing Liu, Beijing (CN); Leilei Zou, Beijing (CN); Jiangshan Zhang, Beijing (CN); Huisheng Wang, Beijing (CN); Biao Tao, Nanjing (CN)

(73) Assignee: University of Science and Technology Beijing, Beijing (CN)

( * ) Notice: Subject to any disclaimer, the term of this patent is extended or adjusted under 35 U.S.C. 154(b) by 0 days.

(21) Appl. No.: 17/897,257

(22) Filed: Aug. 29, 2022

(30) Foreign Application Priority Data

Nov. 11, 2021 (CN) ..... 202111335308.8

(51) Int. Cl.
*B22D 11/22* (2006.01)
*C21D 6/02* (2006.01)
*B22D 11/00* (2006.01)

(52) U.S. Cl.
CPC ..... *B22D 11/225* (2013.01); *B22D 11/001* (2013.01); *C21D 6/02* (2013.01)

(58) Field of Classification Search
CPC ..... B22D 11/225; B22D 11/001; C21D 6/02
See application file for complete search history.

(56) References Cited

U.S. PATENT DOCUMENTS

2009/0084517 A1* 4/2009 Thomas ..... B22D 11/16 164/413

FOREIGN PATENT DOCUMENTS

CN 101474666 A 7/2009
CN 101912953 A 12/2010
(Continued)

OTHER PUBLICATIONS

Hu et al., "Structure-mechanical property relationship in low carbon microalloyed steel plate processed using controlled rolling and two-stage continuous cooling," Materials Science & Engineering, A 585 (2013), pp. 197-204. (Year: 2013).*
(Continued)

*Primary Examiner* — John A Hevey
(74) *Attorney, Agent, or Firm* — Bayramoglu Law Offices LLC

(57) ABSTRACT

A secondary cooling control method for reinforcing surface solidification structure of microalloyed steel continuous casting bloom includes: in situ observing precipitation behavior of secondary phase particles of the microalloyed steel, and determining a concentrated precipitation temperature range; cooling the microalloyed steel at different cooling rates, obtaining a particle size and a volume fraction of the secondary phase particles of the microalloyed steel at different cooling rates; determining an optimal average cooling rate; determining an optimal average cooling rate r; determining an optimal average cooling rate; and determining an optimal average cooling rate range through intersection of the three optimal average cooling rates whereby the continuous casting secondary cooling is optimized. The present invention can enhance the surface solidification structure of continuous casting bloom and reduce surface and subsurface cracks of the microalloyed steel continuous casting bloom.

18 Claims, 6 Drawing Sheets

(56) References Cited

FOREIGN PATENT DOCUMENTS

| | | | | |
|---|---|---|---|---|
| CN | 106694834 | A | 5/2017 | |
| CN | 107091830 | A | 8/2017 | |
| CN | 110695328 | A | 1/2020 | |
| CN | 113600776 | A | 11/2021 | |
| JP | S5732862 | A | 2/1982 | |
| JP | S59212157 | A | 12/1984 | |
| WO | WO-2016009514 | A1 * | 1/2016 | ..... B22D 11/124 |

OTHER PUBLICATIONS

Ma Fan-Jun, et al., Effect of cooling rate on the slab surface microstructure of microalloyed steel containing Nb and Ti, Journal of University of Science and Technology Beijing, 2009, pp. 1116-1121, vol. 31, No. 9.

* cited by examiner

SECONDARY COOLING CONTROL METHOD FOR REINFORCING SURFACE SOLIDIFICATION STRUCTURE OF MICROALLOYED STEEL CONTINUOUS CASTING BLOOM

CROSS REFERENCE TO THE RELATED APPLICATIONS

This application is based upon and claims priority to Chinese Patent Application No. 202111335308.8, filed on Nov. 11, 2021, the entire contents of which are incorporated herein by reference.

TECHNICAL FIELD

The present invention pertains to the field of iron and steel metallurgy continuous casting production, and in particular to a secondary cooling control method for reinforcing surface solidification structure of microalloyed steel continuous casting bloom.

BACKGROUND

By incorporating small amounts of microalloyed elements (such as V, Ti and Nb) in carbon manganese steel to microalloy the steel, the microalloyed elements can play the role of fine grain strengthening and precipitation strengthening, thereby improving strength and toughness of the steel. However, during the continuous casting process, if a secondary cooling process is not properly controlled, carbonitrides of the microalloyed elements such as V, Ti and Nb will precipitate in substantial amounts in austenite grain boundaries, thereby increasing crack sensitivity of the steel, which extremely causes surface and subsurface cracks in the continuous casting bloom. The microalloyed steel continuous casting bloom has high crack sensitivity, the surface and subsurface cracks are all along a factor of restricting improvement of steel quality, and are also critical and difficult points about which metallurgical industry concerns.

In the related art, the principal principle of controlling the surface cracks of the continuous casting bloom is to make the surface temperature out of a third brittle temperature zone during the bending and straightening process. However, due to nonuniform cooling in the continuous casting process, it is difficult to fundamentally eliminate surface cracks by avoiding a brittle temperature zone. Precipitation of a large number of carbonitrides at the austenite grain boundary is an important reason for embrittlement of the microalloyed steel in the third brittle temperature zone. Therefore, distribution morphology and topography of secondary phase particles in steel are improved by regulating water flowrate in secondary cooling zones of continuous casting, which can reduce the temperature range of the third brittle temperature zone, increase high-temperature hot ductility of the microalloyed steel, and thereby fundamentally control the surface and subsurface cracks of the continuous casting bloom.

SUMMARY

In view of the foregoing, embodiments of the present invention provide a secondary cooling control method of reinforcing surface solidification structure of microalloyed steel continuous casting bloom. By obtaining a reasonable cooling rate and clarifying a precipitation temperature range of secondary phase particles, a respective secondary cooling regulation measure is formulated. By precisely controlling precipitation behavior of carbonitride, pinning force of the carbonitride at an austenite grain boundary is weakened; and by increasing hot ductility of the cast bloom, the surface solidification structure is effectively reinforced, and surface and subsurface cracks of the casting bloom are reduced.

To achieve the above objects, the embodiments of the present invention adopt the following technical solutions:

In a first aspect, an embodiment of the present invention provides a secondary cooling control method of reinforcing surface solidification structure of microalloyed steel continuous casting bloom, and the secondary cooling control method comprises the following steps:

Step S1: obtaining a microalloyed steel specimen, heating the specimen to a predetermined temperature, sufficiently redissolving secondary phase particles in the steel, and cooling the specimen at a predetermined cooling rate to room temperature, in situ observing precipitation behavior of the secondary phase particles in the microalloyed steel with a high-temperature confocal laser scanning microscope during the cooling process, and determining a concentrated precipitation temperature range T of the secondary phase particles, wherein a lower limit of the temperature range T is $T_1$;

Step S2: cooling the microalloyed steel at different cooling rates, obtaining a particle size and a volume fraction of the secondary phase particles in the microalloyed steel at different cooling rates, establishing a quantitative relationship between the cooling rate and the average particle size and the average volume fraction of the secondary phase particles, and determining an optimal average cooling rate $v_1$ based on the quantitative relationship:

Step S3: establishing a solidification and heat transfer mathematical model based on an initial water flowrate of secondary cooling zones, calculating a surface temperature of the casting bloom and an average cooling rate of the secondary cooling zones by using the model, and determining a precipitation area of the secondary phase particles on the casting bloom surface with a concentrated precipitation temperature range T of the secondary phase particles;

Step S4: establishing a quantitative relationship between a cooling rate $v_c$ of the last segment of the precipitation process and a temperature at the end of the segment, and determining an optimal average cooling rate $v_2$ based on the quantitative relationship and a lower limit $T_1$ of the concentrated precipitation temperature range T of the secondary phase particles;

Step S5: establishing a quantitative relationship between the cooling rate $v_c$ of the last segment of the precipitation process and a straightening point temperature, and determining an optimal average cooling rate $v_3$ based on the quantitative relationship and an upper limit of a third brittle temperature zone;

Step S6: determining an optimal average cooling rate range $v_0$ that controls precipitation of the secondary phase particles based on the optimal average cooling rate $v_1$, the optimal average cooling rate $v_2$, and the optimal average cooling rate $v_3$, and $v_0=v_1 \cap v_2 \cap v_3$; and Step S7: calculating a precipitation process average cooling rate $\bar{v}_c$, and controlling the secondary cooling of the casting bloom based on the precipitation process average cooling rate $\bar{v}_c$ and the optimal average cooling rate range $v_0$.

In the above solutions, the secondary phase particles are carbonitride particles.

In the above solutions, the volume fraction of the secondary phase particles in step S2 is calculated by formula (1):

$$V = \left(\frac{1.4\pi}{6}\right) \times \left(\frac{ND^2}{A}\right). \quad (1)$$

In formula (1), V is a volume fraction, unit: %; N is the number of the secondary phase particles, D is the particle size of the secondary phase particles, unit: nm; A is an area of a visual field of a field emission scanning electron microscope, unit: $nm^2$.

In the above solutions, establishing a quantitative relationship between the cooling rate and a particle size D and a volume fraction V of the secondary phase particles comprises: calculating a ratio D/V of the average particle size e to the average volume fraction V of the secondary phase particles at the corresponding cooling rate; establishing a quantitative relationship between the D/V and the cooling rate ν, and plotting a D/V-ν relationship graph.

In the above solutions, the optimal average cooling rate $\nu_1$ is determined based on a curve slope of the D/V-ν relationship graph.

In the above solutions, it is determined from the curve slope that $\nu_1$ is not below a cooling rate at which the D/V-ν curve slope drops from the maximum value to 0.02.

In the above solutions, a quantitative relationship between a cooling rate $\nu_c$ in the last segment of precipitation and a temperature at the end of the segment in step S4 is determined by regression fit, and has a formula of:

$$T_{2\ end\ of\ segment} = -139.4\nu_c + 1106.6 \quad (2).$$

In the above solutions, a quantitative relationship between a cooling rate $\nu_c$ in the last segment of precipitation and a temperature at a straightening point in step S5 is determined by regression fit, and has a formula of:

$$T_{straightening} = -23.2\nu_c + 1005.1 \quad (3).$$

In the above solutions, a precipitation process average cooling rate $\overline{\nu}_c$ in step S7 is an average cooling rate of all the secondary cooling zones in which the secondary phase particles are precipitated, and the precipitation process average cooling rate $\overline{\nu}_c$ is calculated by formula (4):

$$\overline{\nu}_c = \sum_{i=1}^{n} \frac{l_i}{l_{tol}} \nu_{ci} \quad (i = 1, 2, \ldots, n) \quad (4)$$

In formula (4), $\overline{\nu}_c$ is the average cooling rate of the secondary phase particle precipitation zone, unit: ° C./s; $\nu_{ci}$ is an average cooling rate of a segment i of the secondary cooling zones, unit: ° C./s; $I_i$ is a length of the segment i of the secondary cooling zone, unit: m; $I_{tol}$ is a total length of the first i segments of the secondary cooling zone, unit: m; n is the number of secondary cooling zones in which the secondary phase particles complete precipitation.

In the above solutions, the microalloyed steel is a non-quenched and tempered steel which belongs to a medium-carbon manganese steel.

The present invention provided by embodiments has the following benefits:

The present invention, based on solidification characteristics of the microalloyed steel, determines two reasonable critical parameters for controlling precipitation of a secondary phase in steel, a cooling rate and a temperature range, and in combination with a proposed method of calculating the average cooling rate of the secondary cooling zones, establishes a new scheme of regulating secondary cooling with controlling precipitation of the secondary phase as a core. The technical solutions contribute to precisely controlling dispersion and precipitation of the secondary phase particles on the surface of the continuous casting bloom, which can significantly reinforce the surface solidification structure and reduce surface cracks of the continuous casting bloom.

BRIEF DESCRIPTION OF THE DRAWINGS

In order to more clearly illustrate embodiments of the disclosure or technical solutions in the prior art, drawings that need to be used in description of the embodiments or the prior art are briefly introduced below, and it will be apparent to those of ordinary skill in the art that the drawings in the following description are only some embodiments of the invention, and other drawings may be obtained in accordance with these drawings without inventive work.

FIGS. 2A-2B are in-situ observation results of precipitation behavior of carbonitride in steel according to an embodiment of the present invention, wherein FIG. 2A is a state in which carbonitride particles start precipitation, and FIG. 2B is a state in which precipitation of the carbonitride particles is saturated;

DETAILED DESCRIPTION OF THE EMBODIMENTS

The embodiments of the present invention will be described in detail below with reference to the accompanying drawings. It should be noted that the described embodiments are merely some but not all of the embodiments of the present invention. Based on the embodiments in the invention, all other embodiments obtained by those of ordinary skill in the art without inventive work shall fall within the protection scope of the present invention.

Regarding technical deficiencies in the related art of controlling surface cracks of a casting bloom, by studying solidification characteristics of microalloyed steel in continuous casting process, deeply analyzing an effect of an cooling rate on precipitation behavior of secondary phase particles, and calculating a cooling rate of each segment in secondary cooling of continuous casting, the present application optimizes a secondary cooling process of continuous casting, strengthens casting bloom surface solidification structure, improves hot ductility of steel, and fundamentally reduces cracks of the microalloyed steel bloom.

Figure 1:
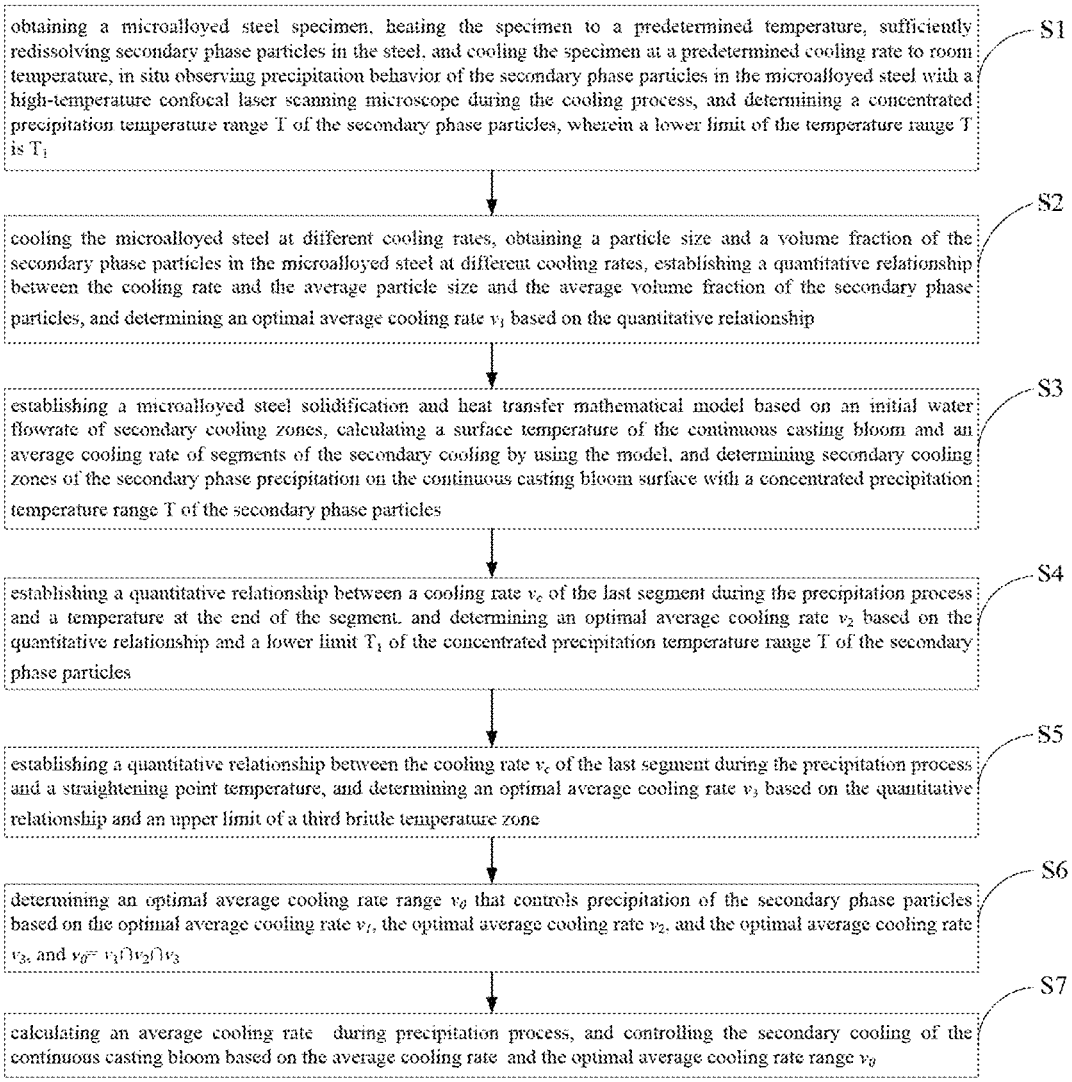
FIG. 1 is a flow chart of a secondary cooling control method for reinforcing surface solidification structure of microalloyed steel continuous casting bloom according to an embodiment of the present invention.

The inventors of the present application have found by deep study that increasing the cooling rate may cause carbonitride to be diffused and precipitated in a steel matrix and weaken a pinning force thereof at austenite grain boundaries, and contributes to reducing proeutectoid ferrite films. However, a high cooling rate acts outside the secondary phase particle precipitation temperature range, which easily increases thermal stress of the casting bloom, and increases the risk of surface cracks. In addition, continued intensive cooling also makes the temperature of the casting bloom too low during bending and straightening process, and lowers hot ductility of the steel. Therefore, it is helpful to increase hot ductility of steel and improve crack defects only if intensive cooling is perfoiined in the secondary phase particle precipitation temperature range. The present application characterizes strength of a grain boundary pinning force by a ratio D/V of a particle size and a volume fraction of the carbonitride particle, which is the basis for formulating a reasonable cooling rate, thereby controlling precipitation of the secondary phase particles. The present application strengthens the continuous casting bloom surface solidification structure by controlling secondary cooling, which effectively avoids the problems that ranges of a cooling rate and cooling time are too wide and difficult to precisely control in the present intensive cooling technology, and a method flow of which is seen in FIG. 1. The present application provides a secondary cooling control method for reinforcing surface solidification structure of microalloyed steel continuous casting bloom, comprising the following steps:

Step S1: obtaining a microalloyed steel specimen, heating the specimen to a predetermined temperature, sufficiently redissolving secondary phase particles in the steel, and cooling the specimen at a predetermined cooling rate to room temperature, in situ observing precipitation behavior of the secondary phase particles in the microalloyed steel with a high-temperature confocal laser scanning microscope during the cooling process, and determining a concentrated precipitation temperature range T of the secondary phase particles, wherein a lower limit of the temperature range T is $T_1$.

In this step, the secondary phase particles are carbonitride particles, such as Nb(C, N) and V(C, N), and the microalloyed steel is non-quenched and tempered steel.

Step S2: cooling the microalloyed steel at different cooling rates, obtaining a particle size and a volume fraction of the secondary phase particles in the microalloyed steel at different cooling rates, establishing a quantitative relationship between the cooling rate and the average particle size and the average volume fraction of the secondary phase particles, and determining an optimal average cooling rate vi based on the quantitative relationship.

In this step, the particle size of the secondary phase particles is measured by a particle diameter D, and the volume fraction is V. Further, the D and V are obtained by a field emission scanning electron microscope. Wherein, the particle size is obtained by Image-Pro software statistics, and each cooling rate requires statistics on at least 10 visual fields of the field emission scanning electron microscope; the volume fraction of the secondary phase particles is calculated by formula (1):

$$V = \left(\frac{1.4\pi}{6}\right) \times \left(\frac{ND^2}{A}\right) \tag{1}$$

In formula (1), V is a volume fraction, unit: %; N is the number of the secondary phase particles, D is the particle size of the secondary phase particles, unit: nm; A is an area of a visual field of a field emission scanning electron microscope, unit: $nm^2$.

Establishing a quantitative relationship between the cooling rate and the particle size and volume fraction of the secondary phase particles specifically includes:

Step S21, calculating a ratio D/V of the average particle size D to the average volume fraction V of the secondary phase particles at a corresponding cooling rate; and Step S22, establishing a relationship between the D/V and the cooling rate ν, and plotting a relationship graph. In this step, the quantitative D/V-ν relationship is determined by non-linear regression fit.

The optimal average cooling rate $\nu_1$ from a D/V-ν curve slope. In this embodiment, it is determined from the curve slope that $\nu_1$ is not below a cooling rate set at which the D/V-ν curve slope drops from the maximum value to 0.02.

For the microalloyed steel, the precipitation of the secondary phase particles, such as Nb(C, N), V(C, N), has a significant effect on casting bloom surface microstructure, which in this embodiment characterizes the strength of the grain boundary pinning force by the ratio D/V of the particle size and the volume fraction of the carbonitrides. The larger the D/V value, the smaller the pinning force at the grain boundaries, which contributes to increasing hot ductility of the cast bloom. The cooling rate has a significant effect on the D/V value, the D/V value increases as the cooling rate increases, and the D/V-ν curve slope increases and then decreases as the cooling rate increases. It has been found through a large number of experimental studies that when the cooling rate increases till the D/V-ν curve slope drops to 0.02 or less, the precipitation of the carbonitrides can be effectively controlled. The optimal average cooling rate is determined in this embodiment as a cooling rate set when the D/V-ν curve slope drops to 0.02 or less.

Step S3: establishing a microalloyed steel solidification and heat transfer mathematical model based on an initial water flowrate of secondary cooling zones, calculating a surface temperature of the continuous casting bloom and an average cooling rate of segments of the secondary cooling by using the model, and determining secondary cooling zones of the secondary phase precipitation on the continuous casting bloom surface with a concentrated precipitation temperature range T of the secondary phase particles.

In this embodiment, the continuous casting secondary cooling zones are divided into four segments, wherein the first segment is intensive cooling, and other cooling segments has mild cooling strength, which is adverse to controlling precipitation of the carbonitrides. In this embodiment, precipitation of carbonitrides on the continuous casting bloom surface is controlled through intensive cooling of first and second segments of secondary cooling.

Step S4: establishing a quantitative relationship between a cooling rate $\nu_c$ of the last segment during the precipitation process and a temperature at the end of the segment, and determining an optimal average cooling rate $\nu_2$ based on the quantitative relationship and a lower limit $T_1$ of the concentrated precipitation temperature range T of the secondary phase particles.

A quantitative relationship between a cooling rate $\nu_c$ in the last segment of the precipitation process and a temperature at the end of the segment in this step is determined by regression fit. A formula of the quantitative relationship determined by regression fit between a cooling rate $v_c$ in the last segment of the precipitation process and a temperature at the end of the segment is:

$$T_{2\ end\ of\ segment}=-139.4v_c+1106.6 \quad (2).$$

Step S5: establishing a quantitative relationship between the cooling rate $v_c$ of the last segment during the precipitation process and a straightening point temperature, and determining an optimal average cooling rate $v_3$ based on the quantitative relationship and an upper limit of a third brittle temperature zone.

A quantitative relationship between a cooling rate $v_c$ in the last segment of the precipitation process and a straightening point temperature in this step is determined by regression fit. A formula of the quantitative relationship determined by regression fit between a cooling rate $v_c$ in the last segment of the precipitation process and the straightening point temperature is:

$$T_{straightening}=-23.2v_c+1005.1 \quad (3).$$

The straightening temperature has a significant effect on the continuous casting bloom surface cracks, and if the cooling rate in the secondary cooling zones is too high, the straightening point temperature of the casting bloom will fall into the third brittle temperature zone. Too high cooling rate would cause the bloom straightener point temperature to fall into the third brittle temperature zone, thereby tending to induce the continuous casting bloom surface cracks. In this embodiment, water distribution in the secondary cooling is directed by obtaining a quantitative relationship between the cooling rate in the secondary cooling zones and the straightening point temperature, such that the straightening point temperature avoids the third brittle temperature zone. Therefore, in order to obtain a better casting bloom surface quality, the cooling rate associated with the straightening temperature is embodied by an optimal average cooling rate range $v_3$, and is controlled to a cooling rate at which the straightening point temperature is not lower than an upper limit of the third brittle zone temperature.

Step S6: determining an optimal average cooling rate range $v_0$ that controls precipitation of the secondary phase particles based on the optimal average cooling rate $v_l$, the optimal average cooling rate $v_2$, and the optimal average cooling rate $v_3$, and $v_0=v_1 \cap v_2 \cap v_3$.

Step S7: calculating an average cooling rate $\bar{v}_c$ ring precipitation process, and controlling the secondary cooling of the continuous casting bloom based on the average cooling rate $\bar{v}_c$ the optimal average cooling rate range $v_0$.

A precipitation segment average cooling rate $\bar{v}_c$ is an average cooling rate of the continuous casting secondary cooling zones in which the secondary phase particles are precipitated. In this step, the average cooling rate $\bar{v}_c$ calculated by formula (4):

$$\bar{v}_c = \sum_{i=1}^{n} \frac{l_i}{l_{tol}} v_{ci} \quad (i = 1, 2, \ldots, n) \quad (4)$$

In formula (4), $\bar{v}_c$ is the average cooling rate of the secondary phase particle precipitation zone, unit: ° C./s; $v_{ci}$ is an average cooling rate of a segment i of the secondary cooling zone, unit: ° C./s; $I_i$ is a length of the segment i of the secondary cooling zone, unit: m; $I_{tol}$ is a total length of the first i segments of the secondary cooling zone, unit: m; n is the number of secondary cooling segments in which the secondary phase particles complete precipitation (namely, a cast bloom temperature is lower than $T_1$).

In this step, a water flowrate in each secondary cooling zone is adjusted based on a difference between the precipitation cooling segment average cooling rate and the optimal average cooling rate range $v_0$.

The invention will be described in further detail below by a specific application example.

Taking SG02 microalloyed steel produced by continuous casting by a steel plant as an example, chemical composition of SG02 steel is as shown in Table 1. SG02 steel continuous casting production conditions and secondary cooling process related parameters are shown in Table 2 and Table 3, respectively. Wherein, the average cooling rate of segments of the secondary cooling is calculated from a solidification heat transfer mathematical model.

TABLE 1

SG02 steel chemical composition (units, %)

| C | Si | Mn | P | S | N | V | Nb | Ti |
|---|---|---|---|---|---|---|---|---|
| 0.43 | 0.45 | 1.41 | 0.01 | 0.0125 | 0.0115 | 0.07 | 0.017 | 0.015 |

TABLE 2

SG02 steel continuous casting process parameters

| Steel Type | Section Size (mm) | Casting Speed (m/min) | Casting Temperature (° C.) | Mold Water Flowrate ($m^3$/h) |
|---|---|---|---|---|
| SG02 | 220 × 220 | 1.05 | 1524 | 120 |

TABLE 3

Length, water flowrate, and cooling rate in each secondary cooling zone

| Cooling Segment | Length (m) | Water Flowrate (L/min) | Cooling rate (° C./s) |
|---|---|---|---|
| First Segment of Secondary Cooling | 0.43 | 46.67 | 2.05 |
| Second Segment of Secondary Cooling | 1.63 | 36.67 | 0.61 |
| Third Segment of Secondary Cooling | 1.89 | 23.33 | 0.50 |
| Fourth Segment of Secondary Cooling | 2.46 | 11.67 | 0.31 |

Figure 2A:
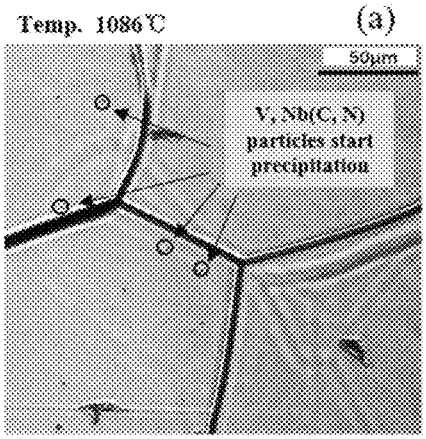
Figure 2B:
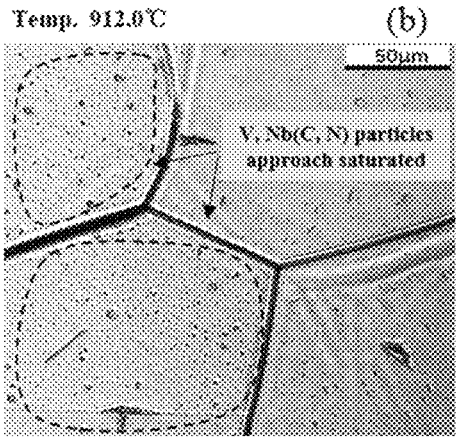
Figure 3A:
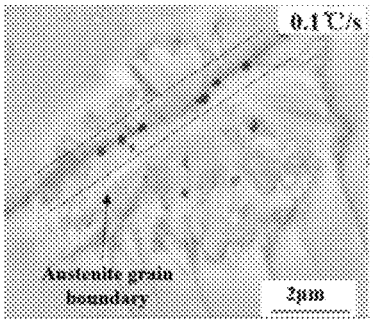
FIGS. 3A-3F are effects of a cooling rate on a particle size and a volume fraction of carbonitride according to an embodiment of the present invention.
Figure 3B:
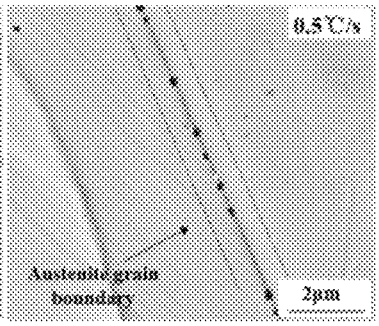
Figure 3C:
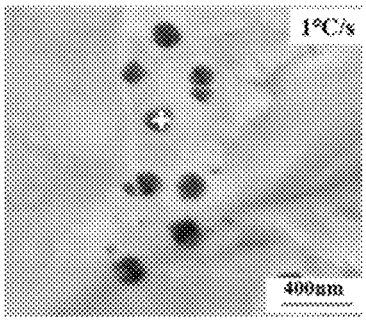
Figure 3D:
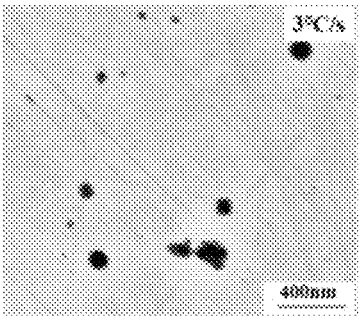
Figure 3E:
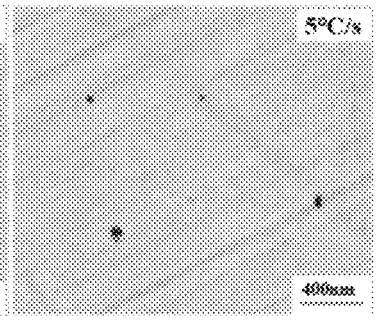
Figure 3F:
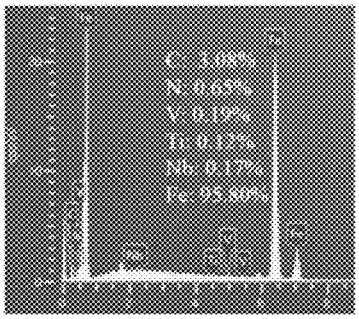

A secondary cooling control method for reinforcing surface solidification structure of SG02 microalloyed steel continuous casting bloom includes the following steps:

Step S1: obtaining a microalloyed steel specimen, heating the specimen to 1480° C., fully dissolving carbonitrides in the steel, in situ observing a precipitation temperature range of the specimen surface carbonitrides at a cooling rate of 0.1° C./s, as shown in FIGS. 2A-2B, and obtaining a concentrated precipitation temperature range T of the carbonitrides of 1086° C. to 912° C. Where a lower limit of the temperature range T is $T_1$ =912° C.

Step S2: warming the sample to 1480° C., sufficiently redissolving the carbonitrides in the steel, and then cooling the specimen to room temperature at cooling rates of 0.1° C./s, 0.5° C./s, 1° C./s, 3° C./s, and 5° C./s, respectively. The cooling process in this step can be integrated with and performed together with the cooling process in step S1.

As shown in FIGS. 3A-3F, a field emission scanning electron microscope is used in combination with an Image-pro software for statistics of an average particle size (D) and an average volume fraction V of the specimen surface carbonitride particles with different cooling rates, statistics of at least 10 field emission scanning electron microscopes visual fields are performed for each cooling rate, wherein the volume fraction is calculated by formula (1):

$$V = \left(\frac{1.4\pi}{6}\right) \times \left(\frac{ND^2}{A}\right) \tag{1}$$

In the formula, V is the average volume fraction, unit: %; N is the number of the secondary phase particles, D is the average particle size of the secondary phase particles, unit: nm; A is a visual field area, unit: $nm^2$.

Figure 4:
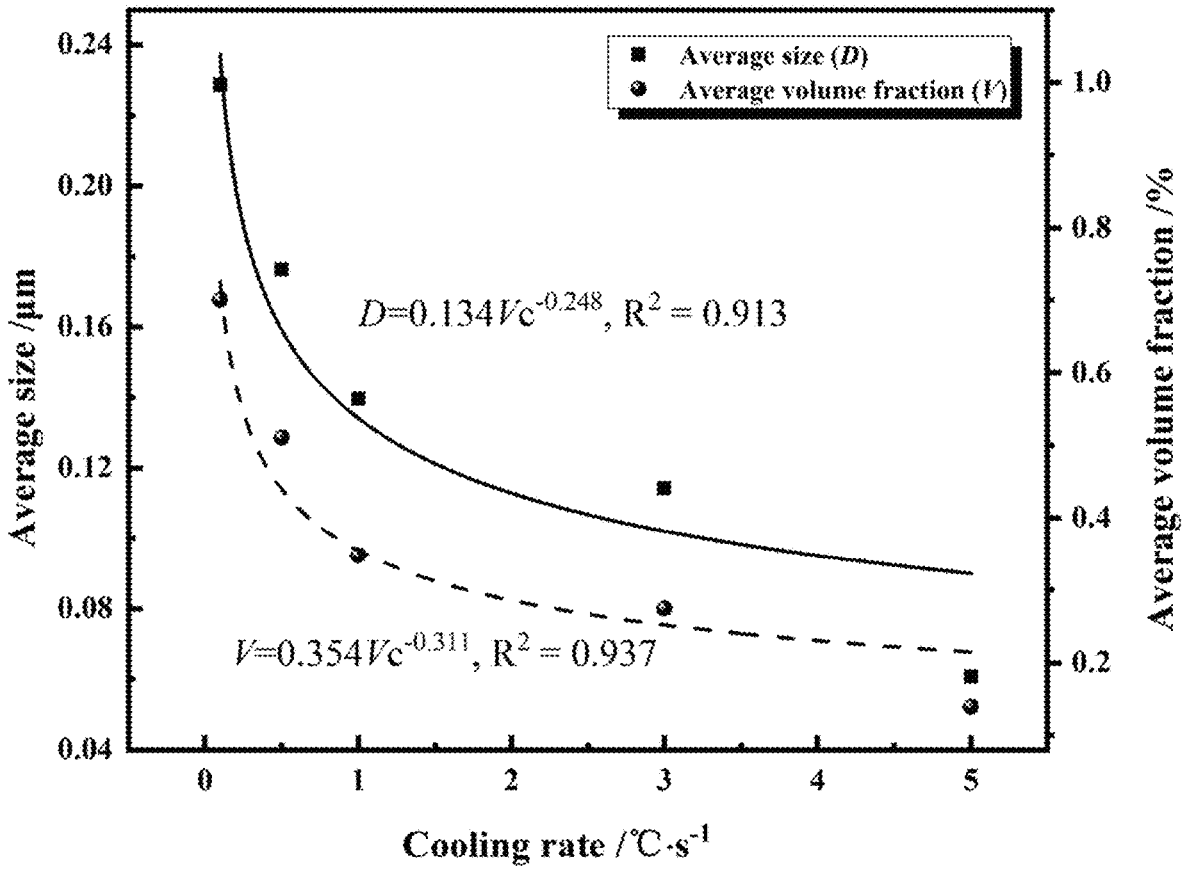
FIG. 4 is distribution and topography of carbonitrides at different cooling rates according to an embodiment of the present invention.
Figure 5:
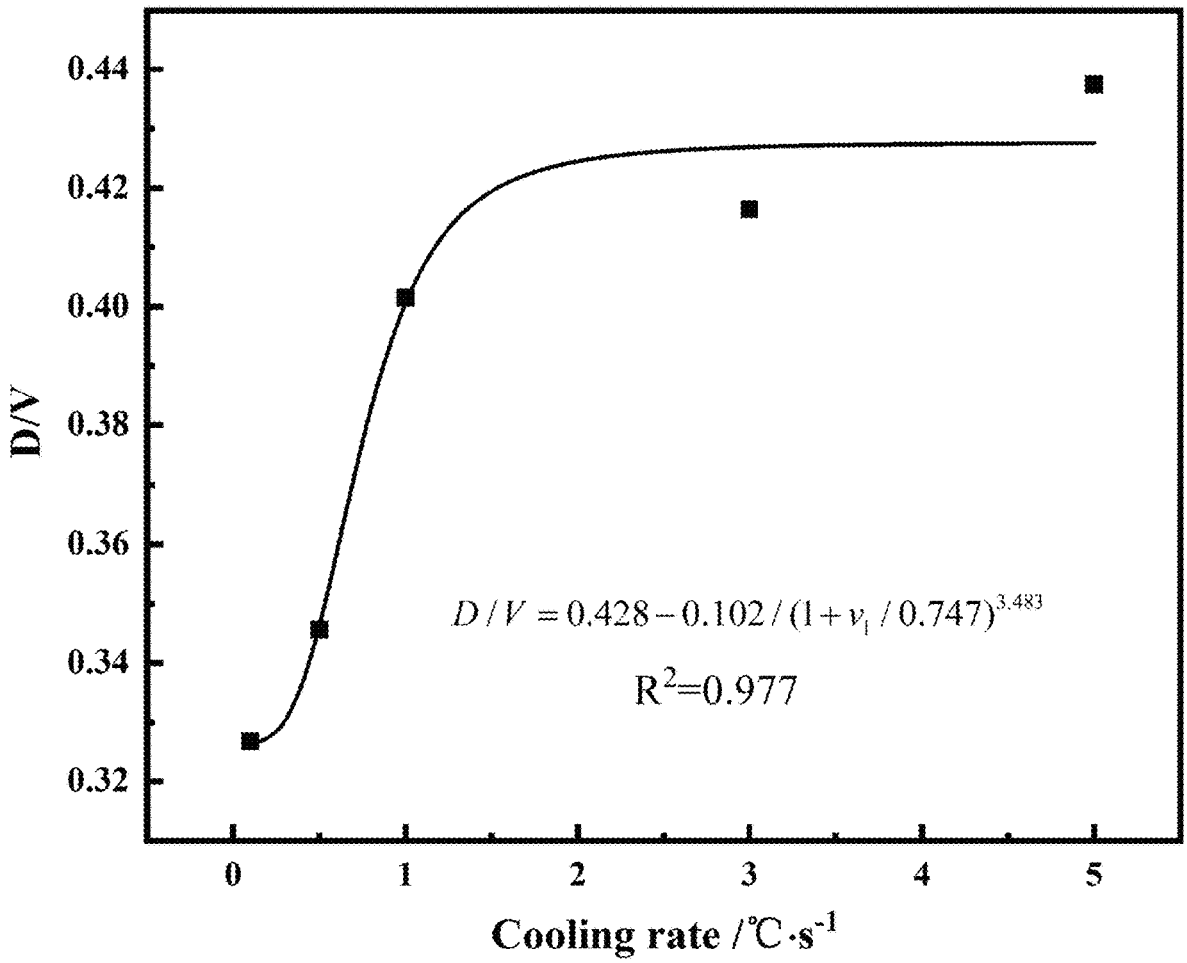
FIG. 5 is an effect of the cooling rate on a D/V ratio according to an embodiment of the present invention.
Figure 6:
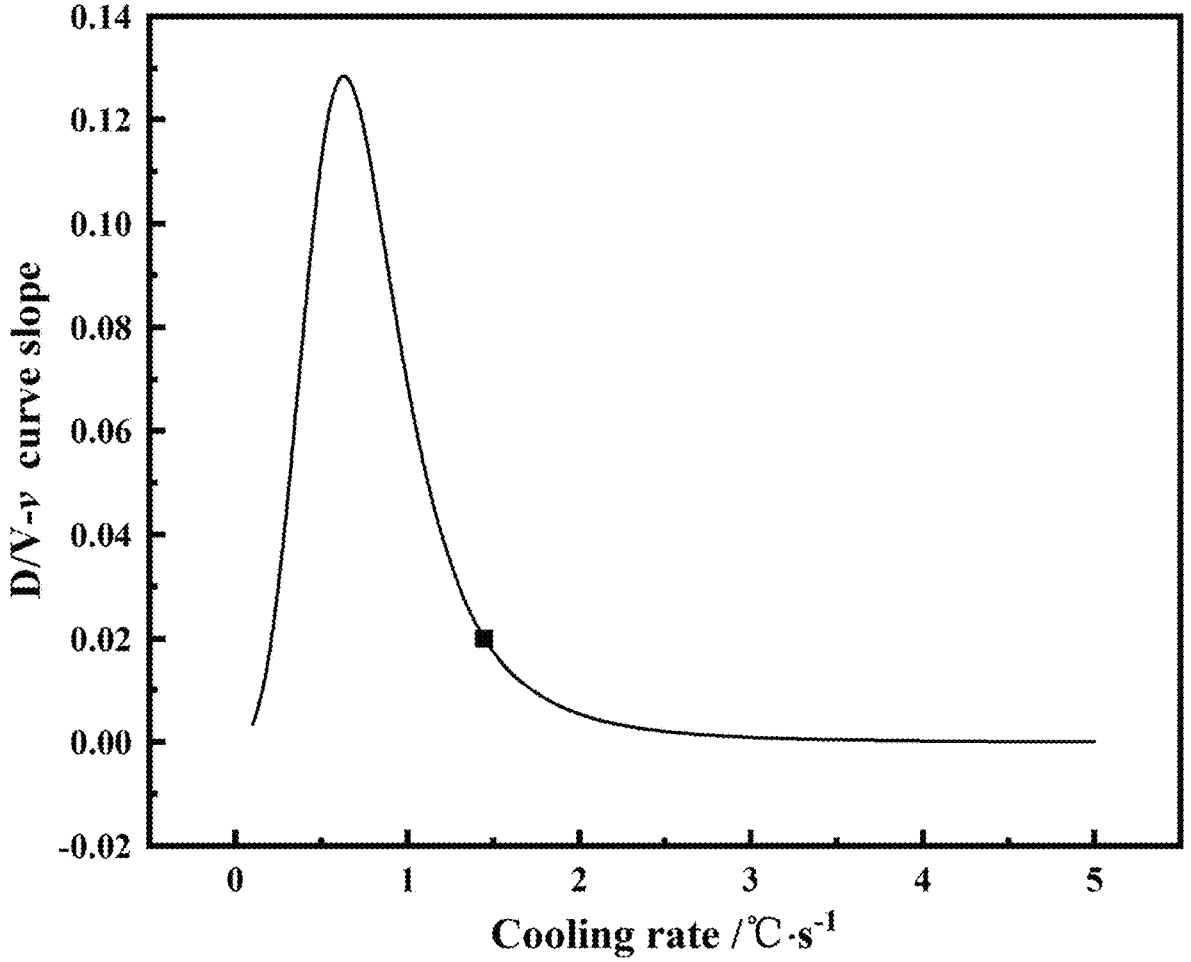
FIG. 6 is a graph of a D/V-ν curve slope according to an embodiment of the present invention.

As shown in FIG. 4, the average size and the average volume fraction are plotted versus the cooling rate, respectively. A non-linear fit is performed on correlation data to obtain a quantitative relationship curve as shown in FIG. 5, whose slope change is shown in FIG. 6. As can be seen in FIG. 6, when the cooling rate is 1.46° C./s, the corresponding curve slope falls from the highest point to 0.02, thereby determining that the optimal average cooling rate range $v_1 \geq 1.46°$ C./s.

Step S3: establishing a target steel type solidification and heat transfer mathematical model based on a continuous casting secondary cooling initial water flowrate, and calculating a continuous casting bloom surface temperature and an average cooling rate of the secondary cooling zones by using the mathematical model, wherein cooling rates of the secondary cooling zones are shown in Table 3. It can be seen from Table 3 that except for the first segment of the secondary cooling, other cooling segments has mild cooling strength, which is adverse to controlling precipitation of the carbonitrides. Therefore, in this embodiment, the precipitation of the continuous casting bloom surface carbonitrides is controlled by intensive cooling of the first and second segments of the secondary cooling, that is, the precipitation process includes the first and second segments, wherein the second segment is the last segment during the precipitation process.

Step S4: obtaining sets of cooling rates by adjusting water volume of the second segment of secondary cooling, and calculating a second segment end temperatures at different cooling rates using the solidification and heat transfer mathematical model. Then, the formula (2) of a quantitative relationship of the cooling rate and the second segment end temperature is obtained by regression fit. Based on a lower limit $T_1$=912° C. of the concentrated precipitation temperature range of the secondary phase particles as the second segment end temperature, $v_c$ is solved as an optimal average cooling rate, and $v_2 \geq 1.40°$ C./s is obtained.

Step S5: obtaining sets of cooling rates by adjusting water flowrate of the second segment of secondary cooling, and calculating temperatures of the surface center of the continuous casting bloom at a straightening point at different cooling rates using the solidification and heat transfer mathematical model. Then, the formula (3) of a quantitative relationship of the cooling rate and the straightening point temperature is obtained by regression fit. Based on an upper limit 927° C. of the third brittle temperature zone as the straightening point temperature, $v_c$ is solved as an optimal average cooling rate, and $v_3 \geq 3.36°$ C./s is obtained.

Step S6: taking intersection of the optimal average cooling rate $v_1$, the optimal average cooling rate $v_2$, and the optimal average cooling rate $v_3$, and determining an optimal cooling rate range $v_0 = v_1 \cap v_2 \cap v_3$ that controls precipitation of the secondary phase particles in the secondary cooling process of continuous casting, 1.46° C./s$\leq v_0 \leq$3.36° C./s. In order to avoid a high cooling rate acting outside the secondary phase particle precipitation temperature range, and meanwhile increase a cast bloom surface center temperature at the straightener point, it is not good for the cooling rate in the second segment of secondary cooling to be too high.

Step S7: calculating a average cooling rate $\bar{v}_c$ of the precipitation process based on formula (4) as follows:

$$\bar{v}_c = \sum_{i=1}^{n} \frac{l_i}{l_{tol}} v_{ci} \quad (i = 1, 2, \ldots, n) \tag{4}$$

In formula (2), $\bar{v}_c$ is the average cooling rate of the secondary phase particle precipitation zone, unit: ° C./s; $v_{ci}$ is an average cooling rate of a segment i of the secondary cooling zone, unit: ° C./s; $I_i$ is a length of the segment i of the secondary cooling zone, unit: m; $I_{tol}$ is a total length of the segment i of the secondary cooling zone, unit: m; n is the number of secondary cooling segments until the secondary phase particles complete precipitation (namely, a cast bloom temperature is lower than $T_1$). As known by calculation, the average cooling rate of the secondary phase particle precipitation zone in the secondary cooling zones in this embodiment is 0.61° C./s.

Figure 7:
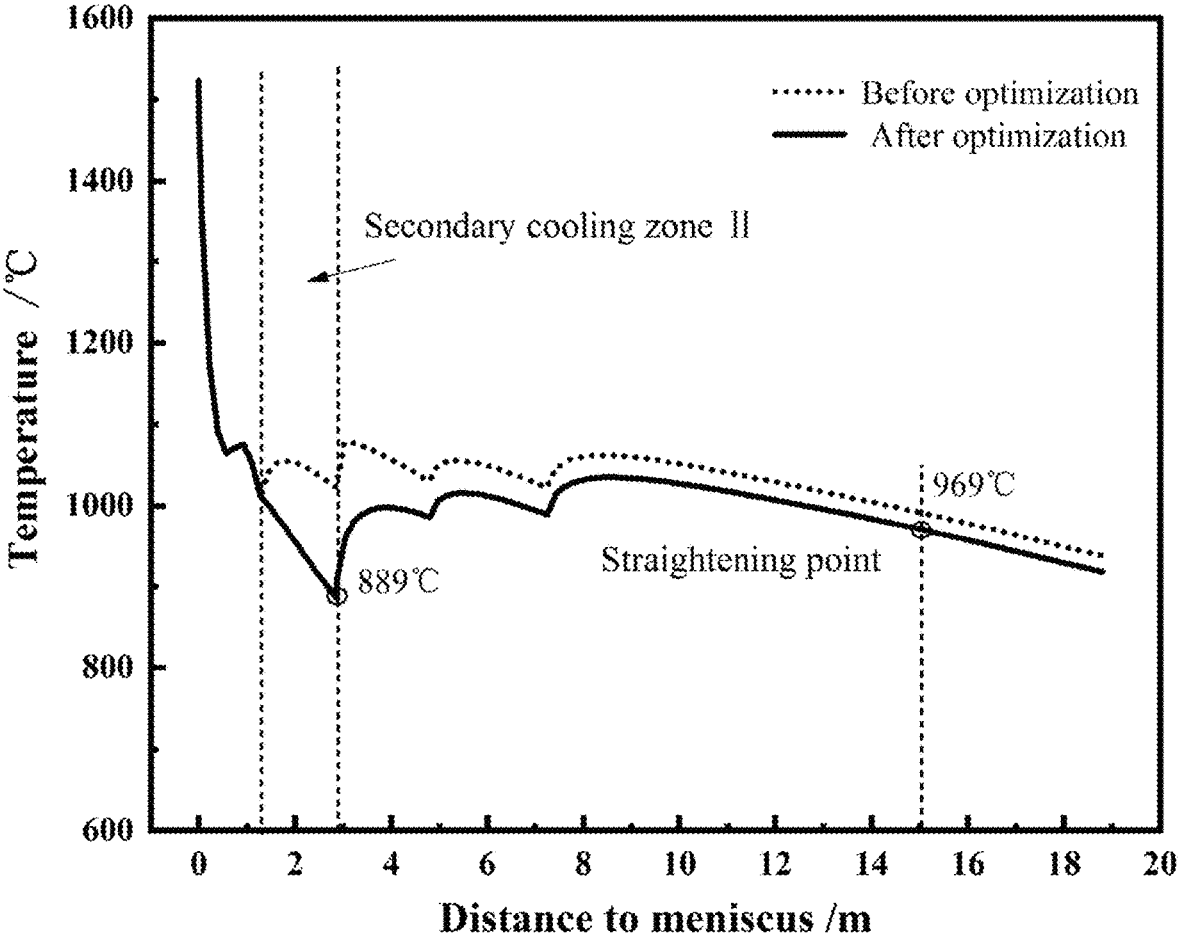
FIG. 7 is a graph in which surface center temperatures of the casting bloom before and after adjustment of a cooling mode are compared according to an embodiment of the present invention.

The secondary cooling of the continuous casting bloom is controlled based on the average cooling rate during precipitation and the optimal average cooling rate range 1.46° C./s$\leq v_0 \leq$3.36° C./s. It can be seen from Table 3 that the average cooling rate $v_c$ of the second segment of secondary cooling is 0.61° C./s, which is below the optimal average cooling rate range $v_0$. Therefore, a water flowrate in the second segment of secondary cooling is adjusted to 3.0 times the initial water flowrate. At this time, the average cooling rate of the second segment of secondary cooling reaches 1.55° C./s, and the average cooling rate of the secondary phase particle precipitation zone in the secondary cooling segments $\bar{v}_c$ (an average cooling rate of the first and second segments of secondary cooling) reaches 1.65° C./s, conforming to range requirements of the optimal average cooling rate range $v_0$. As can also be seen in FIG. 7, the cast bloom temperature at the second segment end after the water flowrate optimization is 891° C., which is slightly below the lower limit T1 of the secondary phase particle precipitation temperature range, and the temperatures of the surface center of the continuous casting bloom at a straightening point also avoids the third brittle temperature zone.

The secondary cooling control method for reinforcing surface solidification structure of SGO2 microalloyed steel continuous casting bloom is applied to actual production. There are fine cracks on the surface and subsurface of the SGO2 casting bloom produced by a steel plant, and before using the secondary cooling control method, detection eligibility of raterolled metal is about 60% on average; after using the secondary cooling control method, the fine cracks on the casting bloom surface substantially disappear, and the detection eligibility of raterolled metal reaches 90% or more, which greatly improves quality of the steel product. The above process is applied to a secondary cooling control process of C38N2 non-quenched and tempered steel, achieving the same effect. At present, the steel plant is speeding up the technology in popularization and application of continuous casting production of a series of non-quenched and tempered steel.

It can be seen from the above technical solutions that the secondary cooling control method for reinforcing surface solidification structure of microalloyed steel continuous casting bloom provided by the embodiments of the present invention, based on solidification characteristics of the microalloyed steel, determines two reasonable critical parameters for controlling precipitation of a secondary phase in steel, a cooling rate and a temperature range, and in combination with a proposed method of calculating the average cooling rate of the secondary cooling zone, establishes a new scheme of regulating secondary cooling with controlling precipitation of the secondary phase as a core. The technical solutions contribute to precisely controlling dispersion and precipitation of the secondary phase particles on the surface of the casting bloom, which can significantly reinforce the surface solidification structure and reduce surface cracks of the casting bloom.

The above description is only detailed description of embodiments of the present invention, but the scope of the invention is not limited thereto, and variations or alternatives that can be easily conceived by any person skilled in the art which the invention discloses shall be encompassed within the scope of the invention. Therefore, the scope of the invention should be subject to the scope of the claims.

What is claimed is:

1. A secondary cooling control method for reinforcing a surface solidification structure of a microalloyed steel continuous casting bloom, wherein the secondary cooling control method comprises the following steps:

Step S1: obtaining a microalloyed steel specimen, heating the microalloyed steel specimen to a predetermined temperature, sufficiently redissolving secondary phase particles in a microalloyed steel, then cooling the microalloyed steel specimen at a predetermined cooling rate to a room temperature, during a cooling process, in situ observing the precipitation behavior of secondary phase particles in the microalloyed steel with a high-temperature confocal microscope, and determining a temperature range T of a concentrated precipitation of the secondary phase particles, wherein a lower limit of the temperature range T is $T_1$;

Step S2: cooling the microalloyed steel at different cooling rates, obtaining a particle size and a volume fraction of the secondary phase particles in the microalloyed steel at the different cooling rates, establishing a quantitative relationship between a cooling rate and an average particle size and an average volume fraction of the secondary phase particles, and determining an optimal average cooling rate $v_i$ based on the quantitative relationship;

Step S3: establishing a solidification and heat transfer mathematical model of the microalloyed steel based on an initial water flowrate of secondary cooling zones, calculating a surface temperature of a continuous casting bloom and an average cooling rate of the secondary cooling zones by using the solidification and heat transfer mathematical model, and determining and controlling a precipitation process of the secondary phase particles on the continuous casting bloom surface with the temperature range T of the concentrated precipitation of the secondary phase particles;

Step S4: establishing a quantitative relationship between a cooling rate $v_c$ of a last segment during the precipitation process and a temperature at an end of the last segment, and determining an optimal average cooling rate $v_2$ based on the quantitative relationship and a lower limit $T_1$ of the temperature range T of the concentrated precipitation of the secondary phase particles;

Step S5: establishing a quantitative relationship between the cooling rate $v_c$, of the last segment of the precipitation segment and a straightening point temperature, and determining an optimal average cooling rate $v_3$ based on the quantitative relationship and an upper limit of a third brittle temperature zone;

Step S6: determining an optimal average cooling rate range $v_0$ based on the optimal average cooling rate the optimal average cooling rate $v_7$, and the optimal average cooling rate $v_3$, the optimal average cooling rate range $v_0$ controlling a precipitation of the secondary phase particles, and $v_0=v_1 \cap v_2 \cap v_3$; and Step S7: calculating an average cooling rate $\bar{v}_c$ of the precipitation process, and controlling the secondary cooling of the continuous casting bloom based on the average cooling rate $\bar{v}_c$ of the precipitation process and the optimal average cooling rate range $v_0$.

2. The secondary cooling control method for reinforcing the surface solidification structure of the microalloyed steel continuous casting bloom according to claim 1, wherein the secondary phase particles are carbonitride particles.

3. The secondary cooling control method for reinforcing the surface solidification structure of the microalloyed steel continuous casting bloom according to claim 1, wherein the volume fraction of the secondary phase particles in the step S2 is calculated by formula (1):

$$V=\left(\frac{1.4\pi}{6}\right)\times\left(\frac{ND^2}{A}\right), \tag{1}$$

in the formula (1), V is the volume fraction, unit: %; N is a number of the secondary phase particles, D is the particle size of the secondary phase particles, unit: nm; A is an area of a visual field of a field emission scanning electron microscope, unit: $nm^2$.

4. The secondary cooling control method for reinforcing the surface solidification structure of the microalloyed steel continuous casting bloom according to claim 3, wherein the quantitative relationship between the cooling rate and the average particle size and the average volume fraction of the secondary phase particles is established, comprising: calculating a ratio D/V of the average particle size D to the average volume fraction V of the secondary phase particles at a corresponding cooling rate; establishing a quantitative relationship between the D/V and the cooling rate v, and plotting a D/V-v relationship graph.

5. The secondary cooling control method for reinforcing the surface solidification structure of the microalloyed steel continuous casting bloom according to claim 4, wherein the optimal average cooling rate $v_1$ is determined based on a curve slope of the D/V-v relationship graph.

6. The secondary cooling control method for reinforcing the surface solidification structure of the microalloyed steel continuous casting bloom according to claim 5, wherein the optimal average cooling rate $v_1$ is not below a corresponding cooling rate when the curve slope of the D/V-v relationship graph drops from a maximum value to 0.02.

7. The secondary cooling control method for reinforcing the surface solidification structure of the microalloyed steel continuous casting bloom according to claim 1, wherein the quantitative relationship between the cooling rate $v_c$ in the last segment of the precipitation process and the temperature at the end of the last segment in the step S4 is determined by a regression fit, and has a formula of:

$$T_{2\ end\ of\ segment}=-139.4v_c+1106.6 \tag{2}$$

8. The secondary cooling control method for reinforcing the surface solidification structure of the microalloyed steel continuous casting bloom according to claim 1, wherein the quantitative relationship between the cooling rate $v_c$ in the last segment of the precipitation process and the straightening point temperature in the step S5 is determined by a regression fit, and has a formula of:

$$T_{staightening}=-23.2v_c+1005.1 \quad (3).$$

9. The secondary cooling control method for reinforcing the surface solidification structure of the microalloyed steel continuous casting bloom according to claim 1, wherein the average cooling rate $\overline{v}_c$ of the precipitation process in the step S7 is an average cooling rate of continuous casting secondary cooling zones with the precipitation of the secondary phase particles; the average cooling rate $\overline{v}_c$ of the precipitation process is calculated by formula (4):

$$\overline{v}_c = \sum_{i=1}^{n} \frac{l_i}{l_{tol}} v_{ci} \quad (i = 1, 2, \ldots, n), \quad (4)$$

in the formula (4), $\overline{v}_c$ is the average cooling rate of a precipitation zone of the secondary phase particle, unit: ° C/s; $v_{ci}$ is an average cooling rate of a segment i of the secondary cooling zone, unit: ° C./s; $I_i$ is a length of the segment i of the secondary cooling zone, unit: m; $I_{tol}$ is a total length of a first i segments of the secondary cooling zone, unit: m; n is a number of secondary cooling segments with a complete precipitation of the secondary phase particles.

10. The secondary cooling control method for reinforcing the surface solidification structure of the microalloyed steel continuous casting bloom according to claim 1, wherein the microalloyed steel is a non-quenched and tempered steel.

11. The secondary cooling control method for reinforcing the surface solidification structure of the microalloyed steel continuous casting bloom according to claim 2, wherein the microalloyed steel is a non-quenched and tempered steel.

12. The secondary cooling control method for reinforcing the surface solidification structure of the microalloyed steel continuous casting bloom according to claim 3, wherein the microalloyed steel is a non-quenched and tempered steel.

13. The secondary cooling control method for reinforcing the surface solidification structure of the microalloyed steel continuous casting bloom according to claim 4, wherein the rnicroalloyed steel is a non-quenched and tempered steel.

14. The secondary cooling control method for reinforcing the surface solidification structure of the microalloyed steel continuous casting bloom according to claim 5, wherein the rnicroalloyed steel is a non-quenched and tempered steel.

15. The secondary cooling control method for reinforcing the surface solidification structure of the microalloyed steel continuous casting bloom according to claim 6, wherein the microalloyed steel is a non-quenched and tempered steel.

16. The secondary cooling control method for reinforcing the surface solidification structure of the microalloyed steel continuous casting bloom according to claim 7, wherein the microalloyed steel is a non-quenched and tempered steel.

17. The secondary cooling control method for reinforcing the surface solidification structure of the microalloyed steel continuous casting bloom according to claim 8, wherein the microalloyed steel is a non-quenched and tempered steel.

18. The secondary cooling control method for reinforcing the surface solidification structure of the microalloyed steel continuous casting bloom according to claim 9, wherein the microalloyed steel is a non-quenched and tempered steel.

* * * * *